United States Patent [19]

Ikunosuke et al.

[11] 4,359,174

[45] Nov. 16, 1982

[54] TABLE AIR POT FOR HOT AND COLD WATER

[76] Inventors: Fukuda Ikunosuke, 1-15, Midori, Isurumi-Ku, Osaka, Japan; Jen-Csung Pan, 8, Lane 24, Jen-Al-Rd., Sec. 2; Shiang-Fu Wang, 516 Tun-Hua S. Rd., Suite 1, 6F, both of Taipei, Taiwan

[21] Appl. No.: 179,007

[22] Filed: Aug. 18, 1980

Related U.S. Application Data

[63] Continuation-in-part of Ser. No. 78,937, Sep. 26, 1979, abandoned.

[51] Int. Cl.[3] ..... B67D 5/60

[52] U.S. Cl. ..... 222/131; 222/209; 222/399; 222/383; 222/400.8; 222/401

[58] Field of Search ..... 222/401, 402, 400.8, 222/400.5, 340, 399, 131, 383, 384, 209, 211, 564; 215/3-5

[56] References Cited

U.S. PATENT DOCUMENTS

| | | | |
|---|---|---|---|
| 2,069,383 | 2/1937 | Nedbalek | 222/401 |
| 2,258,524 | 10/1941 | Vigurs | 222/564 UX |
| 2,920,795 | 1/1960 | Piker | 222/564 X |
| 3,018,022 | 1/1962 | Jones | 222/401 X |
| 3,905,520 | 9/1975 | Nishioka | 222/209 |
| 4,113,147 | 9/1978 | Frazier | 222/401 X |
| 4,116,366 | 9/1978 | Takenakashima | 222/209 X |
| 4,174,053 | 11/1979 | Shimizu | 222/209 |
| 4,238,054 | 12/1980 | Chen | 222/209 X |
| 4,274,562 | 6/1981 | Medeiros | 222/401 |

*Primary Examiner*—Allen N. Knowles
*Attorney, Agent, or Firm*—Imirie & Smiley

[57] ABSTRACT

This invention provides a table air pot for keeping hot or cold liquid comprising a wide mouth vacuum-insulated bottle housed in an outer casing and supported by upper and lower supporting means respectively fixed on the top and bottom ends of the outer casing. The lid of the table air pot includes in combination a bellow-type pump device for pumping up the liquid contained in the bottle into a drink cup while the air pot stands upright on a table, and a plug fixed to the bottom of the pump device for closing the bottle when the lid in its closed position. The tube for discharging the liquid from the bottle in response to the operation of the pump device is fixed on the upper supporting means for the bottle and is physically separated from the plug of the lid. Thus, the table air pot according to this invention can become ready to be filled with liquid by a single operation of opening the lid without need of removing the liquid tube.

4 Claims, 4 Drawing Figures

TABLE AIR POT FOR HOT AND COLD WATER

CROSS REFERENCE TO RELATED APPLICATION

This application is a continuation-in-part of application Ser. No. 78,937 filed Sept. 26, 1979, now abandoned, said application being incorporated herein by reference.

BACKGROUND OF THE INVENTION

This invention relates to a table air pot for keeping liquids hot or cold for a long period of time and more particularly to a table air pot of the type including a wide mouth vacuum-insulated bottle and a pump device for pumping up the liquid contained therein into a drink cup while the air pot stands upright on a table.

An air pot of the above-mentioned type is well known and widely used. In such conventional air pot, the lid of the air pot and the plug for the wide mouth bottle are separately formed as individual parts and the tube for drawing up the liquid contained in the wide mouth bottle is fixedly mounted on the plug. The main disadvantage of such conventional air pot is the inconvenience that on filling in liquid, the user has to open the lid and to remove the plug with the liquid tube mounted thereon. Meanwhile, since the plug is provided with both liquid passage and air passage, the structure thereof is relatively complicated and thus it is required to handle the plug with special care. Further, since the liquid tube is fixedly mounted on the plug, in closing the wide mouth bottle by the plug there is the danger of breaking the bottle, which is made of brittle glass, by the liquid tube extending into the bottle.

SUMMARY OF THE INVENTION

This invention is directed to solving the disadvantages and inconveniences of conventional air pot pointed out above, and has for its object to provide a table air pot in which the lid of the air pot and the plug for the bottle are combined into one integral unit, and the tube for drawing up the liquid contained in the bottle is mounted in such a manner that the opening and closing of the lid together with the plug can be effected without need of removing the liquid tube, so that by a single operation of opening the lid, the user is permitted to fill liquid into the bottle, and there is no fear of damage or breakage of the bottle caused by the movement of the liquid tube plunging into the bottle.

According to this invention, a table air pot comprises an outer casing, a vacuum-insulated wide mouth bottle housed in the outer casing and supported by upper and lower supporting means respectively fixed on the top and bottom ends of the outer casing, the upper supporting means being formed with an opening connected to the wide mouth of the bottle and a liquid outlet outwardly projected from its circumferential wall and adapted to be connected into communication with the inside of the bottle, a liquid tube having one end connected to the liquid outlet and other end extending into the bottle downward to the adjacence of the bottom of the bottle, a lid pivotally connected onto the upper supporting means for the bottle in order to open and close the opening of the upper supporting means, a bellow-type pump device fixed inside the lid, and a plug fixed to the bottom of the pump device for closing the wide mouth bottle when the lid in its closed position, the plug being provided with a passage for the air from the pump device into the inside of the wide mouth bottle.

In one embodiment of the table air pot according to this invention, the liquid tube is connected to the liquid outlet spout via a spout channel and a bend extending through the wall of the upper supporting means for the bottle, and the undersurface of the plug is formed with a recess for accommodating the bend when the lid in its closed position. For assuring the sealing effect of the lid when in closed position, a ring-shaped packing is provided in a groove around the circumference of the upper supporting means.

In a further embodiment of the table air pot according to this invention, the liquid tube is connected to the liquid outlet spout via a spout channel and a bend, the spout channel being formed by a tubular member one end of which opens toward the outlet spout and the other end is provided with an enlarged portion having an opening for connecting the bend. And further, in that portion of the wall of the upper supporting means for the bottle facing the outlet spout, there is formed a slot for snugly receiving the enlarged portion of the spout channel so as to fix the spout channel in position. For assuring the sealing effect of the lid when in closed position, in the upper portion of the upper supporting means there is formed a step surface extending around the circumference of the upper supporting means, and a ring-shaped packing is fitted around the base portion of the plug adjacent to the bottom of the pump device, so that the packing will be closely pressed against the step surface of the upper supporting means to air-tightly closed the opening of the upper supporting means when the lid is closed.

Advantageously, a perforated plate is mounted in adjacence to the bottom of the bottle to prevent the collision of ice cubes with the bottom of the bottle.

BRIEF DESCRIPTION OF THE DRAWINGS

This invention will become more fully understood from the detailed description given hereinbelow and the accompanying drawings wherein.

DETAILED DESCRIPTION OF PREFERRED EMBODIMENTS

Figure 1:
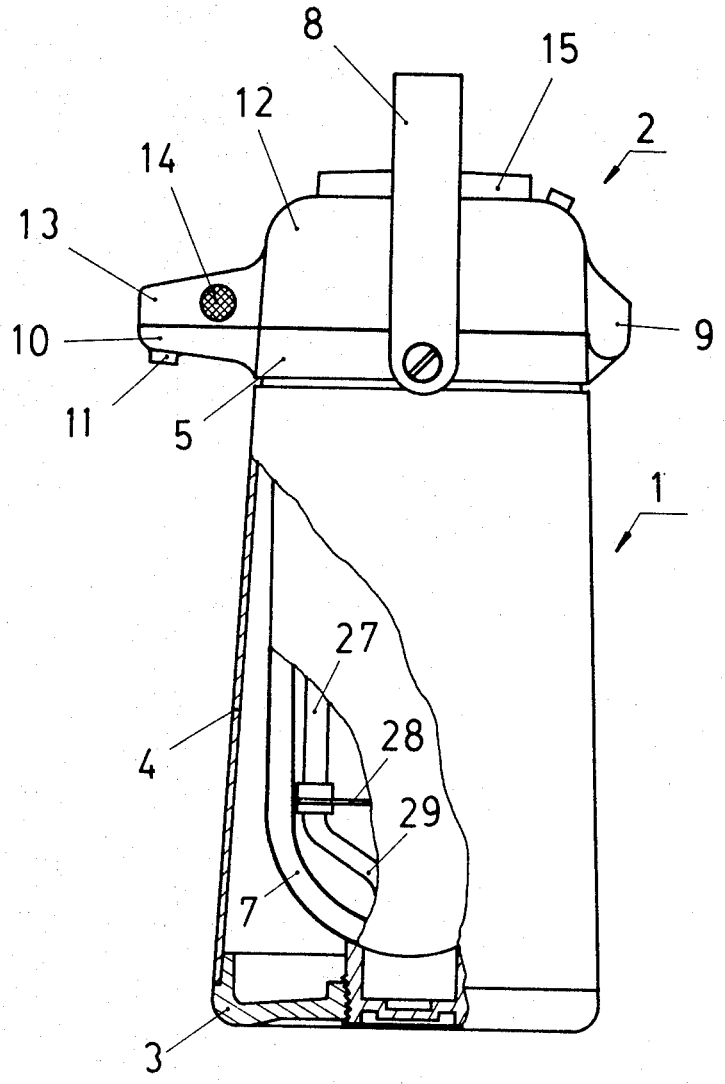
FIG. 1 is a side view of the table air pot according to this invention, with parts partially cut away for illustration.
Figure 2:
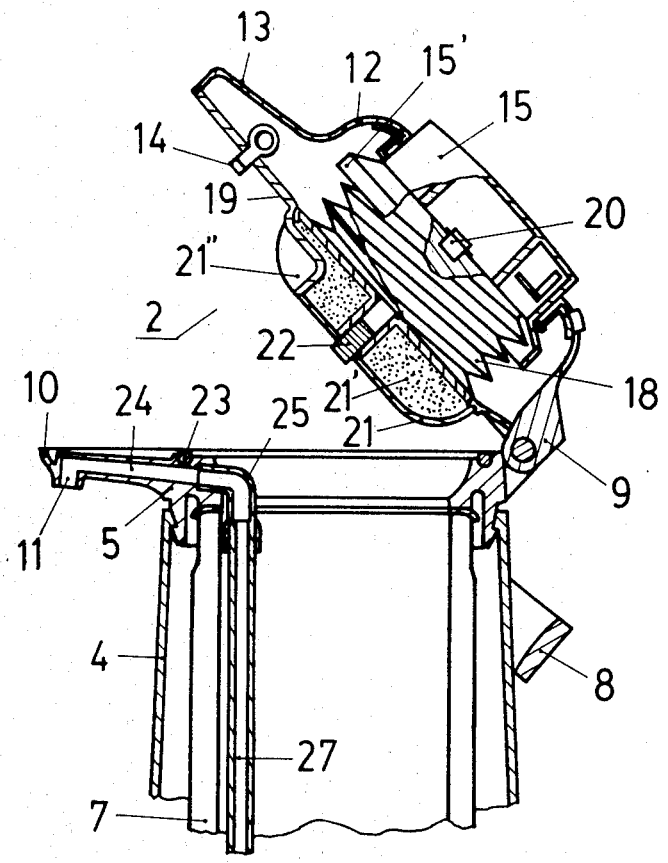
FIG. 2 is a fragmentary cross section view of the table air pot in its opened position.

Referring to FIGS. 1 and 2, one embodiment of the table air pot according to this invention is illustrated. The table air pot comprises a pot body 1 and a lid 2. The pot body 1 includes an outer casing 4, a wide mouth vacuum-insulated bottle 7 housed in the outer casing 4 and supported in position by upper and lower supporting means 5 and 3 which are respectively connected to the top and bottom ends of the outer casing 4 in any suitable manner.

Figure 4:
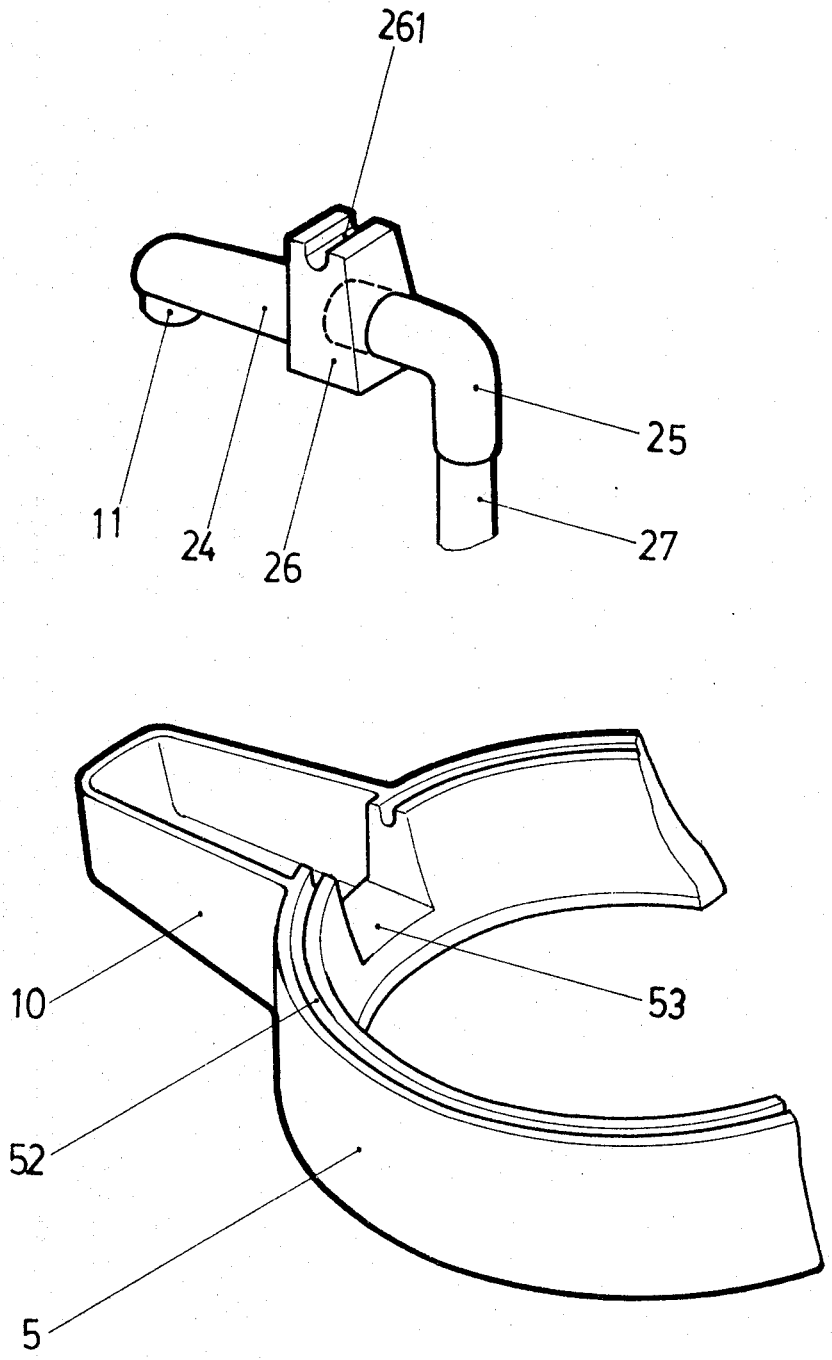
FIG. 4 is a fragmentary perspective view schematically illustrating an alternative arrangement of the upper supporting means for the bottle and the connection between the outlet channel and liquid tube.

The upper supporting means 5 is formed with a funnel-shaped opening corresponding to the inlet portion of the bottle 7, and as shown in FIGS. 2 and 4, in the top surface of the funnel-shaped opening of the upper supporting means 5 there is formed with a circumferential groove for receiving a ring-shaped packing 23 around the funnel-shaped opening.

Further, on the upper supporting means 5 there are formed hinge means 9 for pivotally connecting the lid 2, and an outlet 10 for discharging liquid contained in the bottle 7. The outlet 10 is located diametrically opposite to the hinge means 9 and is projected from the outer circumferential wall as shown in FIGS. 1 and 2. The liquid outlet 10 is integrally formed with a spout channel 24 the outer end of which opens toward outside to form an outlet spout 11. The inner end of the spout channel 24 is connected to an L-shaped bend 25. In addition, as shown in FIG. 2, the spout channel 24 is disposed in inclined manner that the outer end of the spout channel 24 nearby the outlet spout 11 is slightly raised above the inner end thereof so that liquid can immediately stop dropping from the outlet spout 11 when pouring or pumping is stopped. The other end of the L-shaped bend 25 is connected to a liquid tube 27 for drawing up liquid, and the liquid tube 27 extends downward along the inner surface of the wall of the bottle 7.

As shown in FIG. 1, in the lower part inside the bottle 7, there is provided a perforated plate 28 for preventing ice cubes from colliding and breaking the bottom of the bottle, which ice cubes may be added into the bottle to keep the cold liquid contained in the bottle at lower temperature. The perforated plate 28 may be mounted on the lower end of the liquid tube 27, or otherwise, the liquid tube 27 extends through a hole formed in the perforated plate 28 to support the perforated plate 28, and if necessary, the terminate end of the liquid tube 27 may be connected to a bend 29 which opens toward the bottom of the bottle 7, or the liquid tube 27 itself has a length sufficient to extend to the bottom of the bottle with its end bent and open toward the bottom of the bottle.

The lid 2 is pivotally connected to the hinge means 9 formed in the rear side of the upper supporting means 5. The lid 2 includes a plug and a pump device in combination, and the lid 2 can snugly cover the opening of the upper supporting means 5 when in closed position. More specifically, the lid 2 has a cap-shaped housing 12 in conformity with the circumference of the upper supporting means 5, and on the outer circumference of the lid 2 there is formed a hinge-connecting part for being pivotally supported on the above-mentioned hinge means 9, in addition, there is formed an outlet cover 13 corresponding to the outlet 10 formed on the upper supporting means 5, for covering the liquid outlet 10.

The top surface of the housing 12 of the lid 2 is provided with a through-hole in which a pusher member 15 is slidably fitted. The lower part of the pusher member 15 is formed with a skirt portion 15, of enlarged diameter, for receiving the upper part of the bellow-type pump device 18. A bottom plate 19 is fixed onto the undersurface of the lid 2 in order to close the opening of the housing 12 and to fix the bottom of the bellow-type pump device 18 in position on the bottom plate 19. The top and bottom of the bellow-type pump device 18 are respectively provided with air inlet valve 20 and air outlet valve 22, while the air outlet valve 22 extending through the bottom plate 19.

Further, in the position on the bottom plate 19 corresponding to the above-mentioned funnel-shaped opening of the upper supporting means 5, there is fixed a plug 21 for closing the funnel-shaped opening of the upper supporting means 5, and heat-insulating material 21', is filled in the plug 21. Preferably, the plug 21 is formed of soft elastic resin material, and further, in the central portion of the plug 21 there is formed the air outlet of the pump device 18, and in the position on the plug 21 corresponding to the L-shaped bend 25, there is formed a recess 21'' for accommodating the L-shaped bend 25 when the lid 2 in its closed position.

As illustrated in the drawings, the bottom plate 19 and the plug 21 are combined by means of the engaging grooves formed in the housing 12 and the bottom plate 19, however, the combination thereof can also be achieved by any connection means or tap screws as desired. Further, the outlet cover 13 of the housing 12 is provided with a lock means 14 so that the outlet cover 13 can be automatically locked to the liquid outlet 10 of the upper supporting means 5 when the lid 2 is closed, while the lock means 14 can be readily opened to disengage the outlet cover 13 and the outlet 10 when the lid 2 is to be opened. As such lock means 14 can be of any conventional type, the detailed description about the structure thereof is omitted.

The bellow-type pump device 18 is normally biased in expanded condition by spring means such that the pusher member 15 is normally projected outside, in order to pump pressurized air into the bottle to force the hot or cold liquid in the bottle rise up the liquid tube 25 and flow into a drink cup (not shown) by manually pressing down the pusher member 15. Of course, suitable engaging means, as a safety device, can be provided for preventing the upward and downward movement of the pusher member 15 when not in use, in order to prevent undesired or accidental pouring of liquid. As shown in the drawings, numeral 8 indicates a handgrip 8 pivotally mounted onto outer sides of the upper supporting means 5. The lower supporting means 3, the upper supporting means 5 and the lid 2 are respectively formed of synthetic resin, and the outer casing 4 can also be formed of resin material in order to reduce the total weight of the table air pot.

Figure 3:
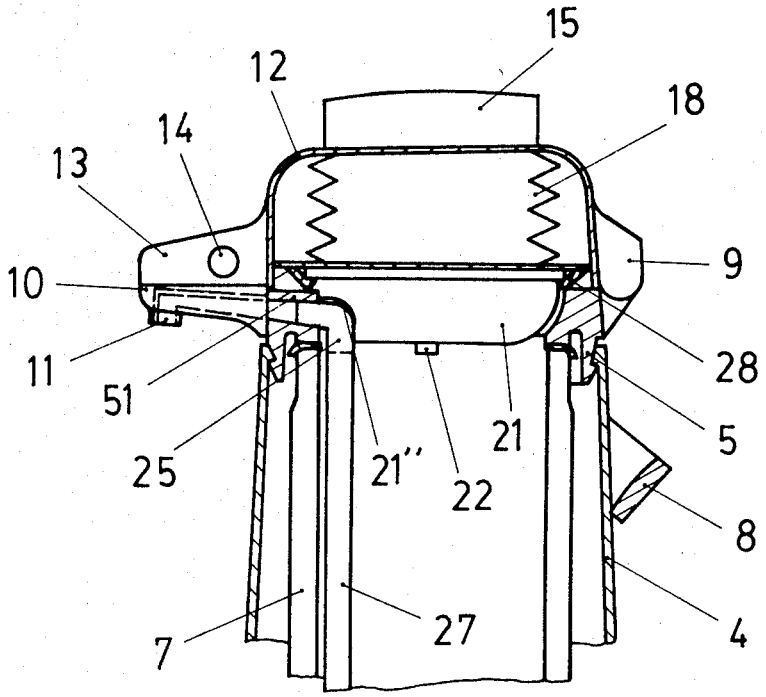
FIG. 3 is a cross section view schematically illustrating the packing arrangement between the engaging surface of the lid and the upper supporting means, for assuring that the opening of the air pot can be air-tightly covered when the lid is closed.

Referring to FIG. 3, there is schematically shown a packing arrangement between the engaging surfaces of the lid 2 and the upper supporting means 5 for assuring that the opening of the air pot can be air-tightly covered when the lid is closed. As shown in FIG. 3, in the upper portion of the upper supporting means 5, there is formed a step surface 5 1 extending around the circumference of the upper supporting means 5, and a ring-shaped packing 28 is fitted around the base portion of the plug 21 adjacent to the bottom plate 19, so that the packing 28 will be closely pressed against the step surface 51 of the upper supporting means 5 to air-tightly close the opening of the upper supporting means 5 when the lid 2 is closed. The packing arrangement shown in FIG. 3 is different from that shown in FIG. 2. In FIG. 2, the packing arrangement is shown as a ring-shaped packing 23 received in a groove formed in the top surface of the upper supporting means 5 as best seen in FIG. 4 (i.e. groove 52).

With respect to the arrangement of the upper supporting means 5 and the connection between the outlet spout channel 24 and liquid tube 27, there is an alternative as schematically shown in FIG. 4. As illustrated in FIG. 4, the spout channel 24 is a tubular member having one end open downward to form a spout 11 and the other end provided with an enlarged portion 26 through which the spout channel (i.e. the tubular member) 24 is connected to the liquid tube 27 via the bend 25. On the other hand, the wall of the upper supporting means 5 is provided with a slot 53 along the path in which the spout channel 24 is to extend. The slot 53 is adapted to snugly receive the enlarged portion 26 of the tubular member 24 so as to fix the spout channel as well as the liquid tube in position. The top surface of the enlarged portion 26 of the tubular member 24 is also provided with a section of groove 261, in order to complete a continuous groove 52 for receiving the ring-shaped packing 23 when the enlarged portion 26 is fitted into the slot 53 of the upper supporting means 5. With such arrangement, the assembling or disasembling operation can be easily facilitated.

The table air pot according to this invention can become ready to be filled with liquid simply by removing the lid 2 about the hinge means 9 into its opened position. The liquid tube 27 is attached to the upper supporting means 5 for the bottle, so that it is convenient for the bottle to receive hot liquid, and there is no fear of breakage of the liquid tube 27. Moreover, the table air pot is constructed of a wide mouth bottle 7, so that piece-like materials such as ice cubes and fruits can be put into the bottle, and it is ready to thoroughly clean the inside of the bottle once the bottle has got dirty. Therefore, the table air pot according to this invention is particularly suitable for domestic use.

We claim:

1. A table air pot comprising:

an elongate outer casing having a top end and a bottom end;

a lower supporting means mounted at said outer casing bottom end;

an upper supporting means mounted at said outer casing top end and including an annular member having a central opening, having a circumferential wall, and having a liquid outlet outwardly projected from said circumferential wall;

a vacuum-insulated wide mouth bottle housed in the outer casing and supported by said upper and lower supporting means, the upper supporting means central opening connected with the wide mouth of the bottle and having substantially the same size diameter as the diameter of said wide mouth, and said liquid outlet adapted to be connected into communication with the inside of the bottle;

a liquid tube having one end connected to the liquid outlet and other end extending into the bottle downward to the adjacency of the bottom of the bottle;

a lid pivotally connected onto the upper supporting means for the bottle in order to open and close the opening of the upper supporting means;

a bellow-type pump device fixed inside the lid; and a plug fixed to the bottom of the pump device for closing the wide mouth bottle when the lid in its closed position.

2. The table air pot as defined in claim 1 wherein said tube is mounted in said upper supporting means and wherein the undersurface of said plug is formed with a recess for accommodating said tube when said lid is in the closed position thereof.

3. The table air pot as defined in claim 1 or 2 wherein the liquid tube is connected to the liquid outlet spout via a spout channel and a bend extending through the wall of the upper supporting means for the bottle.

4. The table air pot as defined in claim 1 or 2 wherein the liquid tube is connected to the liquid outlet spout via a spout channel and a bend, the spout channel being formed by a tubular member one end of which opens toward the outlet spout and the other end is provided with an enlarged portion having an opening for connecting the bend, and in that portion of the wall of the upper supporting means for the bottle facing the outlet spout, there is formed a slot for snugly receiving the enlarged portion of the spout channel so as to fix the spout channel as well as the liquid tube in position.

* * * * *